US005865547A

United States Patent [19]

Harris et al.

[11] Patent Number: 5,865,547

[45] Date of Patent: Feb. 2, 1999

[54] CHECK FLIPPER FOR POINT OF SALE PRINTER AND METHOD THEREFOR

[75] Inventors: Richard Hunter Harris, Raleigh; Robert Andrew Myers, Cary; Jeff David Thomas; Kevin Hunter Vorhees, both of Raleigh, all of N.C.

[73] Assignee: International Business Machines Corporation, Armonk, N.Y.

[21] Appl. No.: 781,771

[22] Filed: Jan. 10, 1997

[51] Int. Cl.[6] ..... B41J 13/00; B65H 39/10

[52] U.S. Cl. ..... 400/578; 271/291; 271/301; 271/225; 347/104; 347/215

[58] Field of Search ..... 400/578; 101/203, 101/231; 271/291, 301, 303; 347/104, 215

[56] References Cited

U.S. PATENT DOCUMENTS

| | | | |
|---|---|---|---|
| 3,114,150 | 12/1963 | Calano et al. | 101/230 |
| 4,714,241 | 12/1987 | Randall | 271/301 |
| 4,785,317 | 11/1988 | Tomoyori et al. . | |
| 4,806,979 | 2/1989 | Tokoro et al. . | |
| 4,928,128 | 5/1990 | Stemmle . | |
| 5,415,391 | 5/1995 | Wong et al. | 271/301 |
| 5,456,539 | 10/1995 | Wright et al. . | |
| 5,513,840 | 5/1996 | Fujita et al. | 271/301 |

OTHER PUBLICATIONS

"Non–Reversing Inverter Conception" Disclosure Journal, vol. 6, No. 5, pp. 265–266, Sep./Oct. 1981.

*Primary Examiner*—Eugene H. Eickholt
*Attorney, Agent, or Firm*—John D. Flynn; Winstead, Sechrest & Minick

[57] ABSTRACT

A print head and check flipper subassembly having a removable flipper cartridge allows printing of both sides of a check or other document in one continuous operation, in which the orientation of the check or other document is reversed in relation to a print head, eliminating the need for an operator to remove and reinsert the check during the printing or handling process.

8 Claims, 9 Drawing Sheets

CHECK FLIPPER FOR POINT OF SALE PRINTER AND METHOD THEREFOR

CROSS-REFERENCE TO RELATED APPLICATIONS

Related subject matter may be found in the following commonly assigned, co-pending U.S. patent applications, both of which are hereby incorporated by reference herein:

(1) Ser. No. 08/781,770, entitled "A Document Feed Roller Opener and Method Therefor" by Richard H. Harris, et al. (Attorney Docket No. RA9-96-064), which is filed concurrently herewith; and (2) Ser. No. 08/781,633, entitled "Curvilinear Pressure Pad for Improved MICR Reading and Method Therefor" by Robert A. Myers (Attorney Docket No. RA9-96-084), which is also filed concurrently herewith.

TECHNICAL FIELD

The invention is drawn to the field of point of sale check printers in general and in particular to point of sale check printers having document handling systems.

BACKGROUND INFORMATION

In ongoing attempts to provide more efficient and convenient service to customers, many retailers have begun to use "point of sale check printers" to reduce the time required for a customer to manually fill out and sign a check. Most people have encountered delays at checkout lines when another customer waits until all of his or her items are checked or scanned to begin to fill out a check for the total purchase. Faster service is provided if the retailer uses a point of sale check printer. A point of sale check printer automatically enters the date, amount of purchase and the name of the retail establishment in the proper spaces on a check, leaving only the signature line blank for the customer to sign. The process of paying by check is therefore made similar to a purchase by credit card, in which all information regarding the date, the amount of the sale and the name of the retail establishment is provided for the customer, who then needs only to sign a receipt to complete the transaction.

A major difference between a credit card purchase and a check purchase, however, is the need for the back of a check to be endorsed, or "franked" by the retail establishment. This step is not required at the point of sale, but, for security reasons, many retail establishments which use a point of sale check printer have a practice of franking each check (with "for deposit only" or other similar notation) as it is received. This lessens the possibility of unrecoverable losses from stolen checks which are later stamped or printed with forged endorsements.

Because the standard location for endorsing or franking a check is on the back, and the standard location for providing all other information is on the front, any check processed by a point of sale check printer must be printed on both sides before such a check may be accepted as payment. Thus, the check must be removed and reinserted to the point of sale printer for information to be printed on both sides.

It is known in the art to encode data on a check with Magnetic Ink Character Recognition ("MICR") technology. In MICR technology, magnetic ink is used to print the customer's account number, a number identifying the bank, and the actual check number on each check. MICR reading machines read this information during the check clearing process to insure the proper account is charged with the amount for which the check is drawn.

Current point of sale check printers are able to read MICR encoding on the check and transmit the encoded data to credit verification agencies. After the information regarding the customer's bank and account number is transmitted to the credit verification agency, a decision may then be made by the retailer whether to accept the presented check. The verification step is not necessary, as some point of sale check printers merely read and record the MICR-encoded data. To use a current point of sale check printer, a cashier inserts the check for reading and verification. After the MICR is read and any verification or approval completed, the back of the check is endorsed or franked.

As previously referred to, all point of sale check printers require that the check be manually removed from the printer and then re-inserted to print the date, the name of the retail establishment and the amount in numeral and word form on the face of the check. This step requires the attention of the cashier, who is thereby temporarily prevented from accomplishing another task such as "bagging" the purchased items. The check must be correctly oriented during the re-insertion, or the information printed on the face will be printed in the wrong places, rendering the check unusable. If the check is rendered unusable, the customer would be asked for a replacement check, which would lessen the customer's confidence in the retail establishment and the check printing process. Also, the interval in which a check is endorsed but not filled out on the face presents a security risk to the customer, who may not want a "blank" check to be out of his or her control. If the check is held in the point of sale printer for a length of time for verification, the cashier may become distracted or may get involved with other tasks. The cashier's attention would have to be regained when the franking step is completed and the check is ready for reinsertion. Until the cashier's attention is redirected to the point of sale printer, the check could be removed by an unauthorized party.

What is needed is a point of sale check printer that completes the steps of MICR-reading, verification (if any), franking, and printing more efficiently. Such a printer would ideally ensure the endorsement and all data on the front are correctly printed, minimize the risk associated with having an incomplete check in the control of store personnel instead of the customer, and would not need constant attention by the cashier during the payment process.

SUMMARY OF THE INVENTION

This invention enhances the usability for check handling in point of sale printers. It frees the operator from the task of retrieving the check after it is endorsed and then having to reinsert it into the printer so that the front face can be printed. A document handling system apparatus is disclosed, comprising a first path for transporting a document having first and second faces, the first path receiving the document with the first face in a first selected orientation and the second face in a second selected orientation, and a circular path for receiving the document from the first path with the first face in the first orientation and the second face in the second orientation and returning the document with the first face in the second orientation and the second face in the first orientation.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION

In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art.

Figure 1:
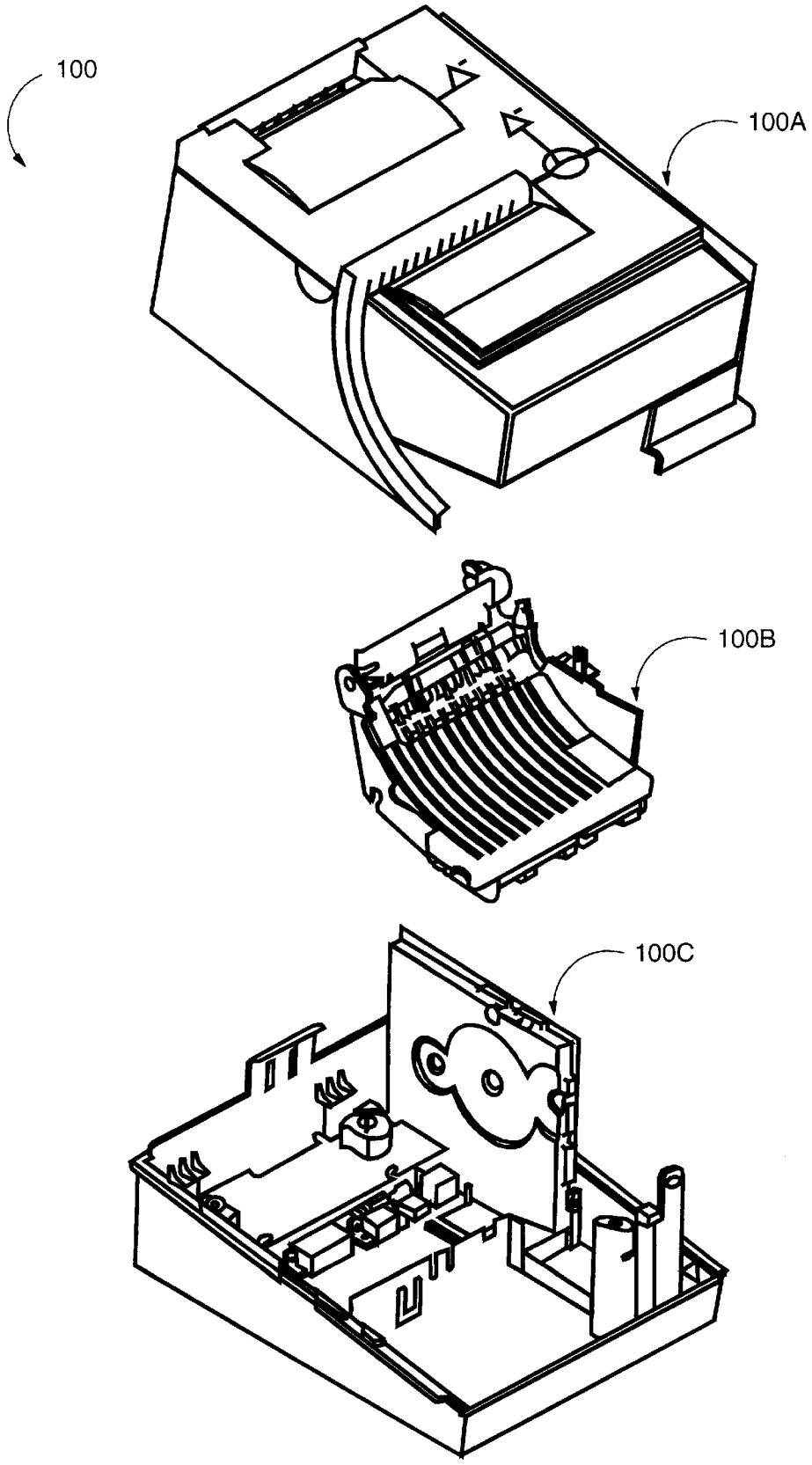
FIG. 1 illustrates an exploded view of a point of sale check printer having a print head and check flipper subassembly in accordance with the present invention.

There is illustrated in FIG. 1 a view of a point of sale check printer assembly 100. Upper housing 100*a* covers inner assembly 100*b*. Lower housing 100*c* provides additional support.

Figure 2:
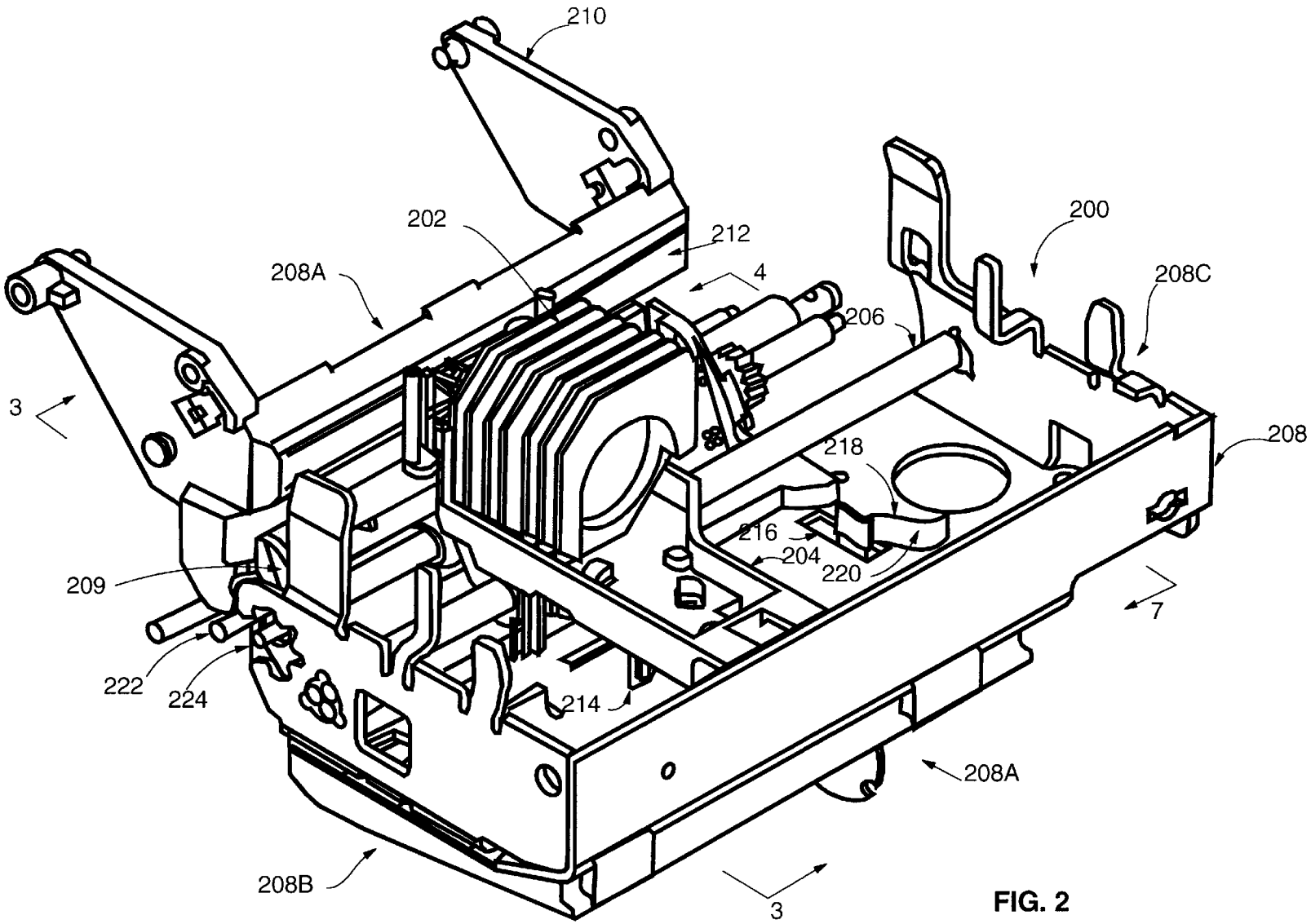
FIG. 2 illustrates an isometric view of a print head and check flipper subassembly for a point of sale check printer in accordance with the present invention.

There is illustrated in FIG. 2 a isometric view of a print head and check flipper subassembly 200 for a point of sale check printer in accordance with the present invention. Print head and check flipper subassembly 200, when used with a point of sale check printer 100, allows a check to be printed on both sides in one multi-step operation. Print head 202 is attached to print head carrier 204. Print head carrier 204 is substantially perpendicular to and slidably disposed on print head carrier bar 206. Print head carrier bar 206 is carried by outer frame 208. Frame 208 has an end plate 208*a*, a first side plate 208*b* and a second side plate 208*c*. Print head carrier 204 is driven from side to side, back and forth between first side plate 208*b* and second side plate 208*c*, along print head carrier bar 206 by well known means. Such means may include a direct current reversing stepper motor connected to print head carrier 204 by a drive belt and pulley mechanism.

Platen 210 is attached to outer frame 208 and opposite end plate 208*a*. Printing surface 212 is attached to platen 210 such that printing surface 212 faces end plate 208*a*.

Depending downwardly from print head carrier 204 is post 214. Outer frame 208 defines slot 216, with actuator 218 extending therethrough. Actuator 218 has angled surface 220 extending diagonally towards end plate 208*a* and second side plate 208*c* at an angle to both print head carrier 204 and print head carrier bar 206. As print head carrier 204 is driven towards actuator 218, post 214 engages angled surface 220, driving actuator 218 forward along slot 216 towards platen 210.

Inner frame 209 is connected to outer frame 208. Front feed roller axle 222 is carried by inner frame 209. Rear feed roller axle 224 is carried at one end by outer frame 208 near side plate 208*b* and at the other end by inner frame 209, near side plate 208*c*. Front feed roller axle 222 and rear feed roller axle 224 are substantially perpendicular to print head carrier 204 and substantially parallel to print head carrier bar 206. Front feed roller axle 222 is positioned near platen 210 and rear feed roller axle 224 positioned near end plate 208*a*.

Figure 3:
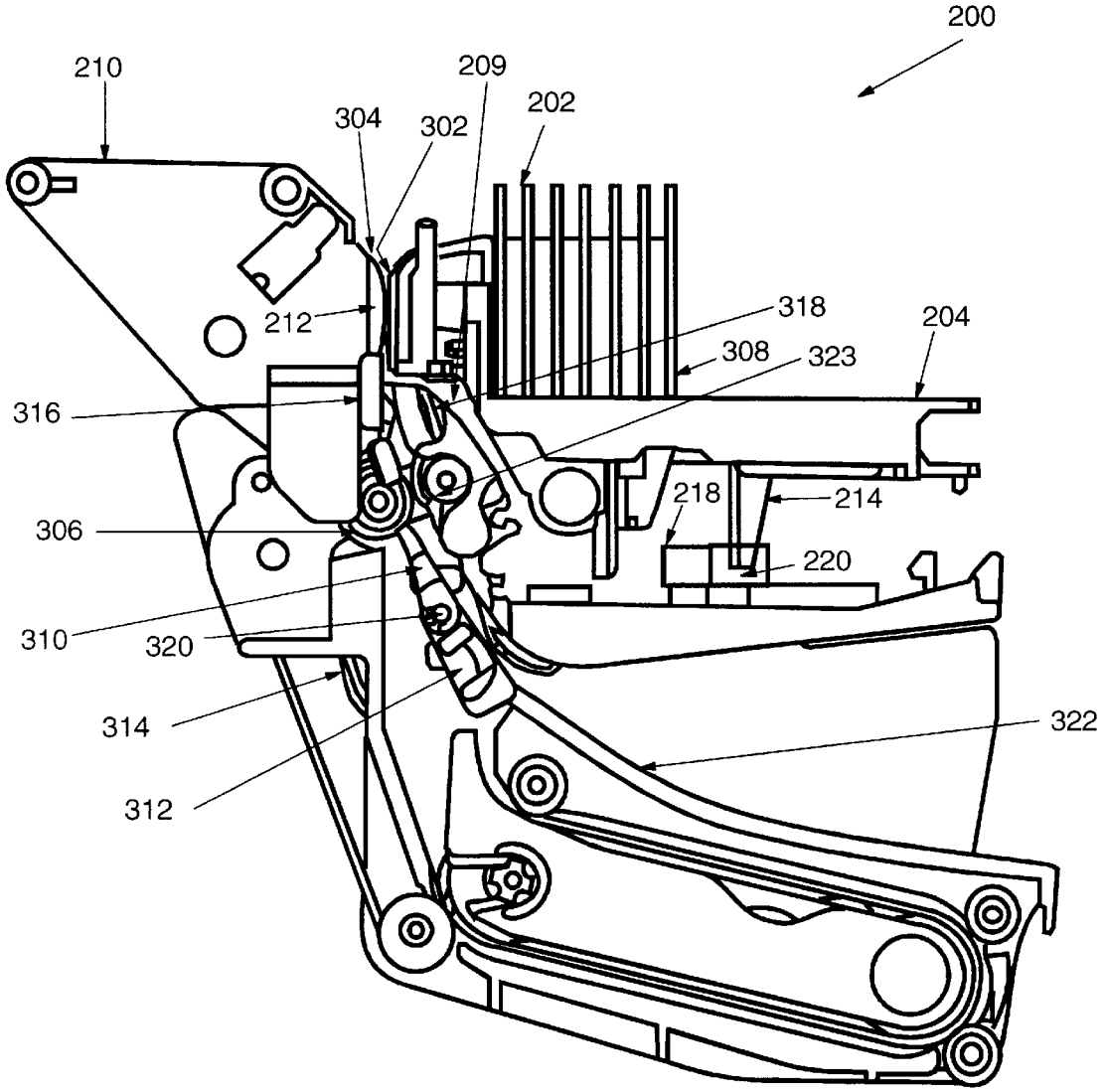
FIG. 3 illustrates a left side view of the print head and check flipper subassembly of FIG. 2 in the normal print mode, with the outer frame removed for clarity.

There is illustrated in FIG. 3 a left side view of print head and check flipper subassembly 200 along line 3—3 of FIG. 2. Print head and check flipper subassembly 200 is illustrated in normal print mode. Normal print mode is one of two modes of operation of print head and check flipper subassembly 200, wherein the other mode of operation is a flipping mode. In FIG. 3, outer frame 208 has been removed and is not illustrated for clarity. It should be understood that the view illustrated in FIG. 3 is of the side of print head and check flipper subassembly 200 which would display first side plate 208*b*, had outer frame 208 not been removed and had print head and check flipper subassembly 200 not been sectioned along line 3—3.

Print head 202 and printing surface 212 of platen 210 define document entrance 302. Upper paper path 304 is defined by document entrance 302, front feed roller 306 and lower feed roller 308, along with upper gate 310, lower gate 312 and upper surface 314. Checks to be printed are inserted through document entrance 302 into upper paper path 304. Document entrance 302 is a first point along upper paper path 304. Various operations and mechanisms are located at points along upper paper path 304, as will be subsequently described herein.

MICR reader 316 is attached to platen 210 below printing surface 212. MICR reader 316 is a second point of upper paper path 304 After a check is inserted through document entrance 302 and into upper paper path 304, the check is moved past MICR reader 316 to allow MICR reader 316 to read the information printed in ferromagnetic indicia, or "magnetic ink" on the check and translate the information into a format usable by computers or other devices. The operation of MICR reader 316 is well known in the data processing art and will not be described in greater detail herein. Upper sensor 318 is provided adjacent MICR reader 306 to detect the presence of a check in upper paper path 304. Upper sensor 318 may be attached to inner frame 209, platen 210 or to print head and check flipper subassembly 200 by other means. Upper sensor 318 may be electrical, photo-electrical, mechanical, or may operate by other methods, so long as it is capable of detecting the presence or absence of a check in upper paper path 304 and providing a signal in response thereto.

A third point along upper paper path 304 is defined by front feed roller 306 and rear feed roller 308. Front feed roller 306 is mounted on front feed roller axle 222 and rear feed roller 308 is mounted on rear feed roller axle 224. Both front and rear feed rollers 306 and 308 preferably have circumferential surfaces of rubber, soft plastic or the like. Rear feed roller 308 is biased toward front feed roller 306, so that front and rear feed rollers 306 and 308 are in contact with each other. Front and rear feed rollers 306 and 308 are separable, however, by separating one end of front and rear feed rollers 306 and 308 by providing a lever to be actuated by post 214 or other element connected to print head carrier 204. Such a lever would be operativley connected one of front or rear feed rollers 306 or 308 or front or rear feed roller axles 222 and 224 such that displacement of the lever by post 214 would move one of front or rear feed rollers 306 or 308 away from the other. Alternatively, front and rear feed rollers 306 and 308 may be separated by well known means in which the circumferential surfaces of front and rear feed rollers 306 and 308 are parallel to each other once front and rear feed rollers 306 and 308 are separated.

A fourth point along upper paper path 304 is defined by upper gate 310, lower gate 312, and upper surface 314. Upper gate 310 and lower gate 312 are hingedly coupled to pin 320 so that upper gate 310 and lower gate 312 may swing between first and second positions. Pin 320 is attached to inner frame 209. Upper gate 310, in its first position, is positioned toward platen 210. When in a second position, upper gate 310 is extended toward end plate 208*a*. Lower gate 312, in its first position, is positioned toward end plate 208*a* of outer frame 208. When in a second position, lower gate 312 is extended toward platen 210. In normal print mode, upper gate 310 is in its first position, extended toward platen 210 and lower gate 312 is in its first position, extended towards end plate 208*a*, such that upper gate 310 and lower gate 312 are substantially parallel to upper surface 314. Upper paper path 304 continues past upper gate 310, lower gate 312, and upper surface 314 into lower document throat 322.

A fifth point along upper paper path 304 is lower sensor 323. Lower sensor 323 is attached to inner frame 209 behind rear feed roller 308. Lower sensor 323 may be electrical, photo-electrical, mechanical, or may operate by other methods, so long as it is capable of detecting the presence or absence of a check in upper paper path 304 and providing a signal in response thereto.

In operation of a point of sale check printer in accordance with the present invention, the lower edge of a check having a front side and a back side is inserted in upper paper path 304 until the lower edge is detected by upper sensor 318 as the lower edge is pushed against front and rear feed rollers 306 and 308 respectively. The check is inserted with its back side toward print head 202. The presence of the lower edge of the check, as detected by upper sensor 318, provides a signal to enable front feed roller 306 and rear feed roller 308 to start rotating in the forward direction. Because front and rear feed rollers 306 and 308 are in contact with each other, the check is drawn between front and rear feed rollers 306 and 308 and moved forward along upper paper path 304. Power to rotate front and rear feed rollers 306 and 308 is provided by well known means, such as an electric motor connected to front feed roller axle 222 (motor is not shown). The operation of an electric motor in both the forward and the reverse direction, along with the control mechanism and circuitry to reverse such a motor is well known in the printer art and will not be described in greater detail herein.

As illustrated in FIG. 3, during the forward direction rotation of front and rear feed rollers 306 and 308, front feed roller 306 rotates clockwise and rear feed roller rotates counterclockwise to advance the check along upper paper path 304. As the check is advanced along upper paper path 304, the information printed on the check in magnetic ink is read by the MICR reader 316, translated, and transmitted for any desired recordkeeping or verification.

After the check has advanced sufficiently along upper paper path 304, the upper edge of the check will advance beyond upper sensor 318. Upper sensor 318 senses that the upper edge of the check has advanced beyond upper sensor 318 and provides a signal to stop the rotation of front and rear feed roller 306 and 308. The check is held therebetween, with the lower edge of the check in lower document throat 322.

If the MICR-encoded information is used to verify that the account upon which the check is written contains enough funds to cover the amount purchased, for a review of the credit history of the customer, or for any other purpose, the information detected by MICR reader 316 is transmitted to an appropriate location by well known means. During this time, the check is held between front and rear feed rollers 306 and 308 in print head and check flipper subassembly 200.

Once any desired approval for the check is received, front and rear feed rollers 306 and 308 begin to rotate in reverse. As illustrated in FIG. 2 during reverse rotation, front feed roller 306 rotates counterclockwise and rear feed roller 308 rotates clockwise, causing the check to reverse its direction of travel back along upper paper path 304 towards document entrance 302. As the check is being pushed backwards along upper paper path 304, information such as "for deposit only," is printed by print head 202 on the back side of the check. The printing is done in "portrait mode," by moving print head 202 laterally along print head carrier bar 206 back and forth between first side plate 208*b* and second side plate 208*c* of frame 208, while print head 202 prints characters and information by well known means.

After the check has been endorsed by print head 202, the check continues to be driven backwards along paper path 204 until the lower edge of the check is retracted past lower sensor 323. Lower sensor 323 senses that the lower edge of the check has retracted past lower sensor 323 and provides a signal to stop the rotation of front and rear feed rollers 306 and 308, which holds the check therebetween.

Figure 4:
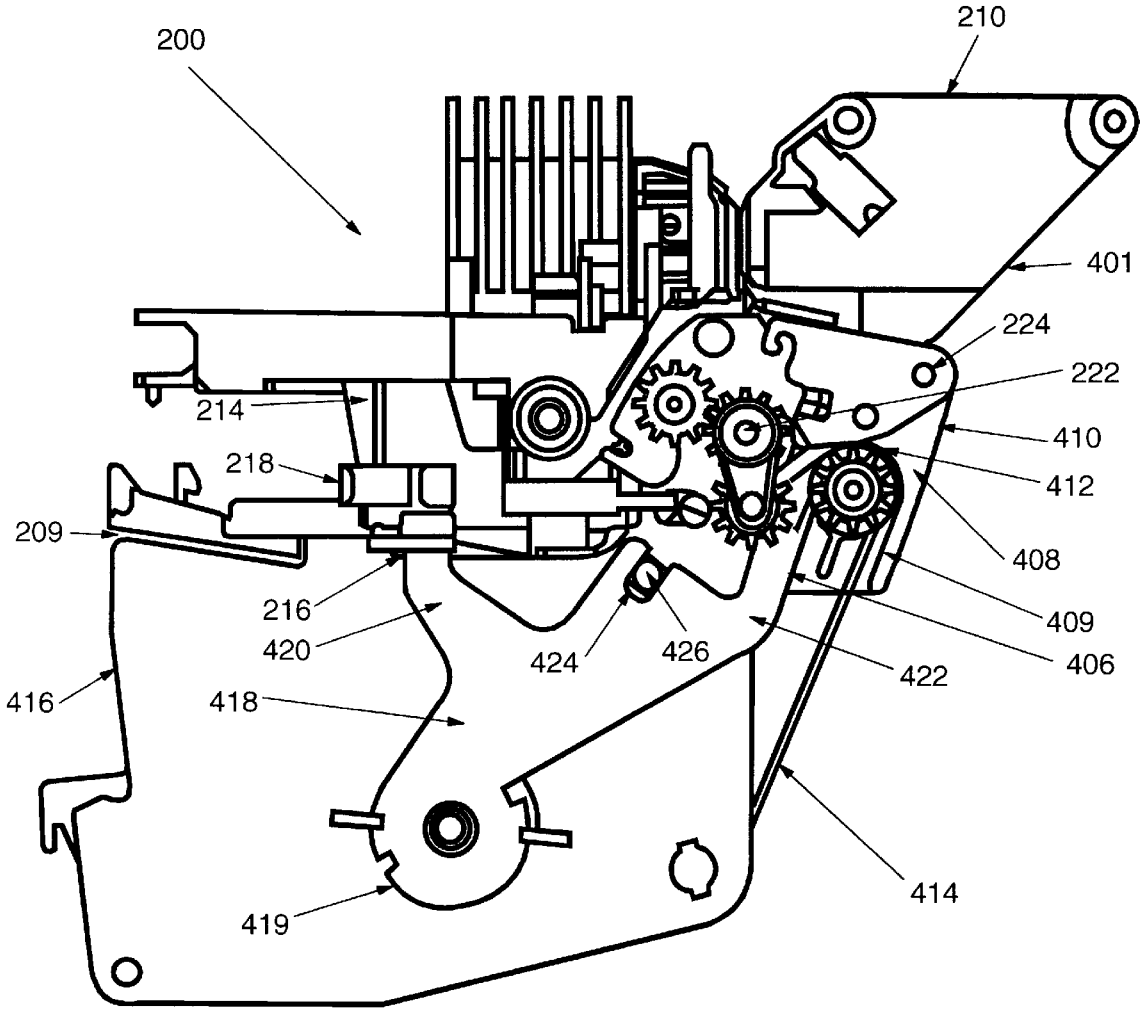
FIG. 4 illustrates the right side of the print head and check flipper subassembly of FIG. 2 in the normal print mode, with the outer frame removed for clarity.

There is illustrated in FIG. 4 a right side view of print head and check flipper subassembly 200 along line 4—4 of FIG. 2. Print head and check flipper subassembly 200 is illustrated in the normal print mode. Outer frame 208 has been removed for clarity. It shall be understood that the view in FIG. 4 is of the side of print head and check flipper subassembly 200 which would display second side plate 208*c*, had outer frame 208 not been removed and had print head and check flipper subassembly 200 not been sectioned along line 4—4 of FIG. 2.

Front feed roller gear 402 is coupled to front feed roller axle 222. Rear feed roller gear 404 is coupled to rear feed roller axle 224. Gears 402 and 404 are in engagement with each other, such that the rotation of one gear is in the opposite direction to the rotation of the other. Accordingly, when rear feed roller gear 404 is rotating in the clockwise direction, front feed roller gear 402 rotates in the counterclockwise direction, and when rear feed roller gear 404 is rotating in the counterclockwise direction, front feed roller gear 402 rotates in the clockwise direction. Power to rotate gears 402 and 404 is provided by well known means, such as an electric motor connected to front feed roller axle 222

(motor is not shown). Idler gear 406 is driven by front feed roller gear 402. Idler gear bracket 408 is loosely mounted to front feed roller axle 222 such that rotation of front feed roller axle 222 will cause idler gear bracket 408 to also rotate. Idler gear bracket 408 is not securely fastened to front feed roller axle 222; therefore should the rotation of idler gear bracket 408 be stopped from further rotation, then front feed roller axle 222 will be allowed to continue rotating. The teeth of idler gear 406 are maintained in engagement with the teeth of front feed roller gear 402 by idler gear bracket 408. Idler gear 406 is rotatably mounted to idler gear bracket 408 by idler gear axle 409.

Front frame 410 is attached to inner frame 209 below platen 210. Check flipper drive gear 412 is rotatably connected to front frame 410. Check flipper drive gear 410 drives drive belt 414 in corresponding rotation such that clockwise rotation of check flipper drive gear 410 results in clockwise travel of drive belt 414.

Inner frame 209 comprises plate 416, to which lever 418 is rotatably mounted along axis 419. Lever 418 is spring biased in its counterclockwise, or rearward, position towards end plate 208*a*. Lever 418 comprises rear arm 420, front arm 422, and middle slot 424. Rear arm 420 extends through slot 216 and is attached to actuator 218. Front arm 422 extends in front of axle 409 and holds axle 409 and idler gear 406 towards end plate 208*a*.

Tab 426 is disposed in middle slot 424. Tab 426 extends from middle slot 424 and tab 426 to lower gate 312, and is attached to lower gate 312, such that rotating lever 418 towards platen 210 will also move lower gate 312 towards platen 210.

Figure 5:
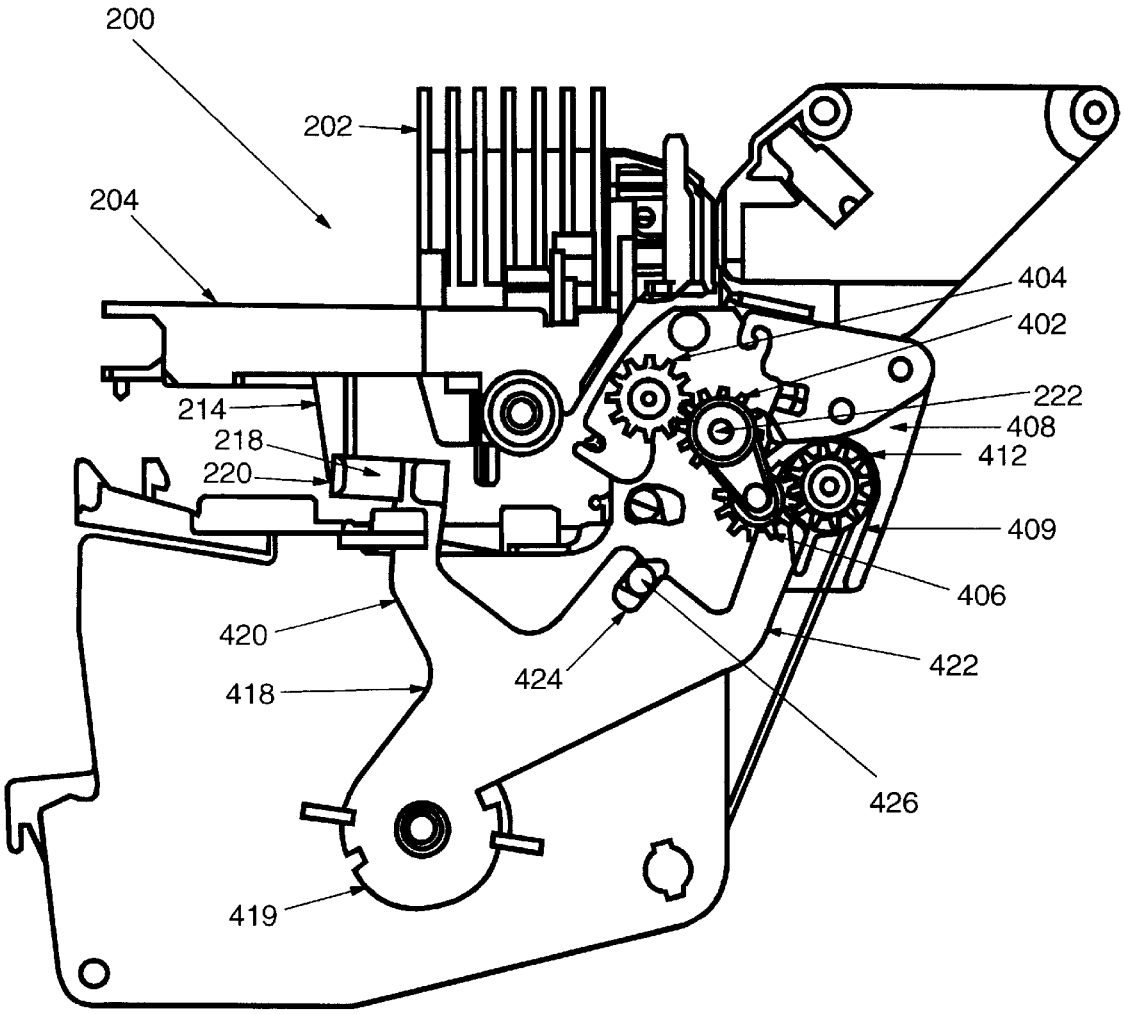
FIG. 5 illustrates the right side of the print head and check flipper subassembly of FIG. 2 in the flipping mode, with the outer frame removed for clarity.

Turning now to FIG. 5, print head and check flipper subassembly 200 is illustrated from a same view as that illustrated in FIG. 4. In FIG. 5, however, print head and check flipper subassembly 200 is in the flipping mode. Flipping mode is initiated as print head carrier 204 is moved towards second side plate 208*c* and plate 416, causing post 214 to engage angled surface 220 of actuator 218 and causing actuator 218 to be driven forward toward platen 210. It should be noted that this will happen when print head carrier 204 is positioned outside a normal zone. As lever 418 is driven toward platen 210, front arm 422 is lifted off of idler gear axle 409. Rotational force is then applied to front feed roller axle 222, causing front feed roller 306 and rear feed roller 308 to rotate in the forward direction. As illustrated in FIG. 5, the forward rotation of front and rear feed rollers 306 and 308 corresponds to a counterclockwise rotation of front feed roller gear 402 and a corresponding clockwise rotation of rear feed roller gear 404 and idler gear 406. Idler gear bracket 408 is mounted on front feed roller axle 222 with a slight amount of drag, so that the rotation of front feed roller axle 222 will tend to cause idler bracket 408 to rotate also. The rotation of idler gear bracket 408, however, may be stopped without stopping the rotation of front feed roller axle 222.

The counterclockwise rotation of front feed roller gear 402 and front feed roller axle 222 will also cause idler bracket 408 to turn in a counterclockwise direction. Opposing further counterclockwise rotation of idler gear bracket 408 and idler gear 406 is check flipper drive gear 412. As the teeth of idler gear 406 are brought into contact with the teeth of check flipper drive gear 412, check flipper drive gear 412 begins to rotate in a counterclockwise direction. The counterclockwise rotation of check flipper drive gear 412 causes a subsequent counterclockwise rotational travel of drive belt 414.

Should print head carrier 204 be moved away from plate 416, post 214 will become disengaged from actuator 218. Lever 418 is spring biased to its counterclockwise, or rearward position, causing front arm 422 to pull idler gear axle 409 and idler gear 406 away from check flipper drive gear 412 and allow check flipper drive gear 412 to come to a stop.

In initial flipping mode, lever 418 is shifted towards platen 210. During this shifting, middle slot 424 also pushes tab 426 towards platen 210. Tab 426 extends through print head and check flipper subassembly 200 and is connected to lower gate 312, such that pushing tab 426 towards platen 210 will also cause lower gate 312 to be pushed towards platen 210.

Figure 6:
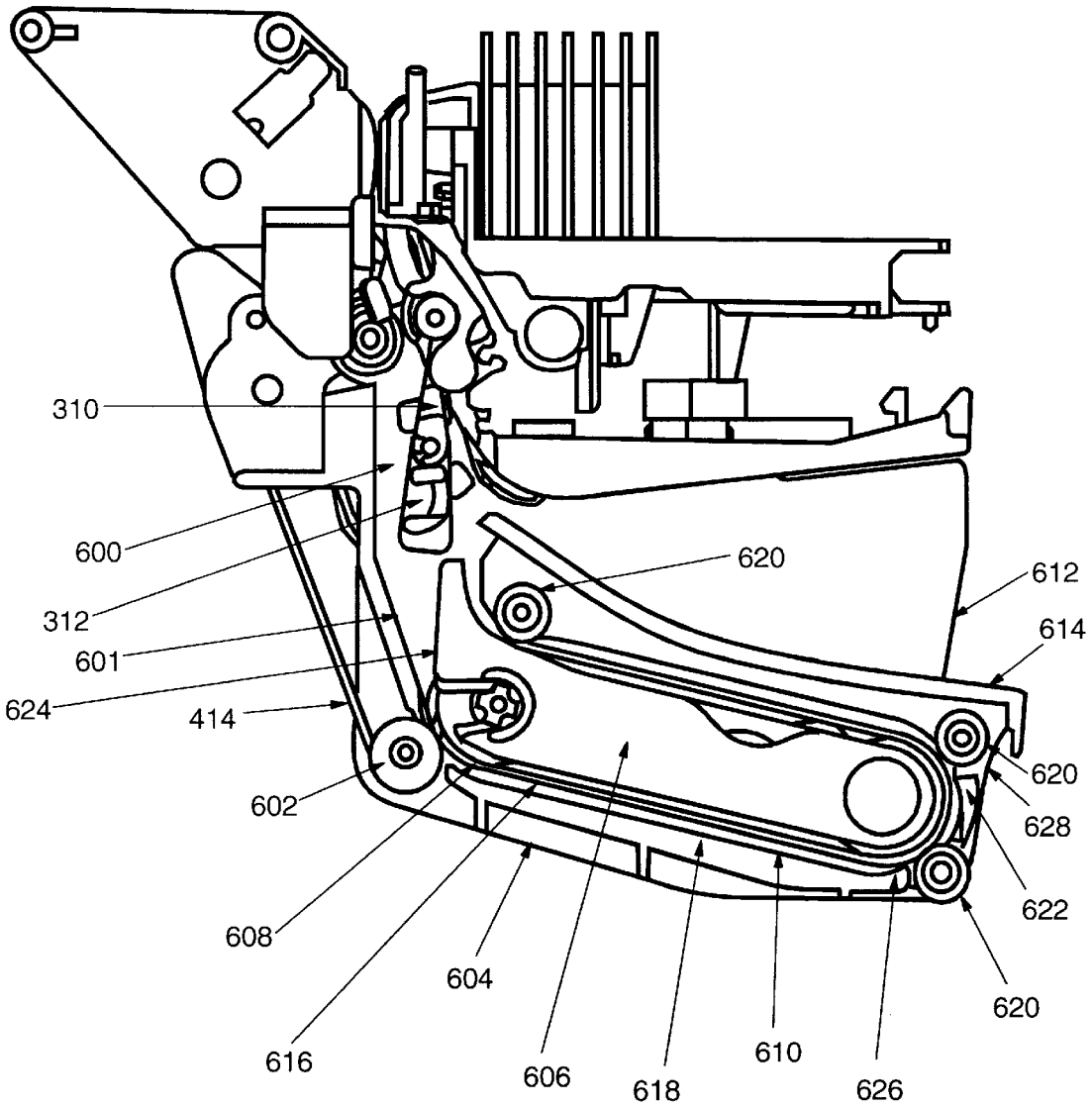
FIG. 6 illustrates the left side of the print head and check flipper subassembly of FIG. 2 in the flipping mode, with the outer frame removed for clarity.

Turning now to FIG. 6, print head and check flipper subassembly 200 is illustrated from the same view as that illustrated in FIG. 3. In FIG. 6, however, print head and check flipper 200 is in the flipping mode. In flipping mode upper gate 310 and lower gate 310 are rotated in a clockwise fashion. Lower gate 312 is driven from its rear position towards platen 210 by the action of middle slot 424 of lever 418, as lever 418 is driven to towards platen 210. Upper gate 310 is spring biased to maintain its alignment with lower gate 312, therefore upper gate 310 concurrently travels from its frontward position away from platen 210.

The shift of upper gate 310 away from platen 210 and the shift of lower gate 212 towards platen 210, opens lower paper path 600. Lower paper path is defined by upper gate 310, lower gate 312, and lower surface 601.

Drive belt 414 is driven by check flipper drive gear 412 of (check flipper drive gear 412 is not viewable in FIG. 6). Drive belt 414 is wrapped around check flipper drive wheel 602. Therefore the rotation of check flipper drive gear 412 causes rotation of check flipper drive wheel 602 in the same direction. Check flipper drive wheel 602 is preferably provided with gear teeth. Check flipper drive wheel 602 is mounted to flipper frame 604.

Flipper cartridge 606 is removably inserted into flipper frame 604. Flipper cartridge 606 contains a front wheel 608 and rear wheel 610. Around front wheel 608 and rear wheel 610 is disposed belt 612. Belt 612 is preferably made of natural or synthetic rubber, or a soft plastic material to enable frictional contact between belt 612 and a check or other document. Front wheel 608 has gear teeth which engage the gear teeth of check flipper drive wheel 602 when flipper cartridge 606 is installed in flipper frame 604.

Flipper frame 604 and print head and check flipper subassembly 200 have access door 614. Access door 614 is preferably removable from print head and check flipper subassembly 200, but may be hinged at the edge of access door nearest platen 210. As access door 614 is hinged up or removed, flipper cartridge 606 may be inserted or removed from flipper frame 604.

Flipper frame 604 is provided with a plurality of idler wheels 620. Idler wheels 620 are in contact with belt 612. In a preferred embodiment, two idler wheels are attached to the lower surface of access door 614 and a third idler wheel is attached to flipper frame 604. As access door 614 is raised, the upper two idler wheels 620 are also raised away from flipper cartridge 606. This allows flipper cartridge 606 to be removed from flipper frame through the opening created by the lifting of access door 614 in the event a check has become jammed in lower paper path 600 or circular paper path 624. Flipper frame 604 has bottom support 618 and rear guide 622.

Circular paper path 624 is defined by check flipper drive wheel 602 and belt 612, belt 612 and bottom support 618, and front wheel 608, belt 612 and rear wheel 610. As circular paper path 624 passes check flipper drive wheel 602, it is further defined as bottom support 618, rear guide 622, the underside of access door 614, and idler wheels 620.

Bottom support 618 has upturned portion 626 to direct the check between belt 612 supported by rear wheel 610 and idler 620. Rear guide 622 has a similar upturned portion 628 to guide the check between belt 612 and idler 620.

Print head and check flipper subassembly 200 is put into flipping mode by post 214 of print head carrier 204 contacting angled surface 220 of actuator 218, and moving lever 418 towards platen 210. After print head and check flipper subassembly 200 has been put into flipping mode, front and rear feed rollers 306 and 308 begin to rotate in the forward direction. Due to the shift of upper and lower gates 310 and 312, lower paper path 600 is opened to direct the check along lower surface 601 towards check flipper drive wheel 602 and front wheel 608. Because the surface of check flipper drive wheel 602 is in contact with belt 612, the check is drawn between check flipper drive wheel 602 and belt 612. As the lower end of the check passes between check flipper drive wheel 602 and belt 612, the check enters circular paper path 624.

As the check enters and is advanced along circular paper path 624, the upper edge of the check advances beyond lower sensor 323, providing a signal for front and rear feed rollers 306 and 308 to separate. Check flipper drive wheel and belt 612 continues to advance the check along circular paper path 624. Upturned portions 626 and 628 direct the check in between idlers 620 and belt 612.

Figure 7:
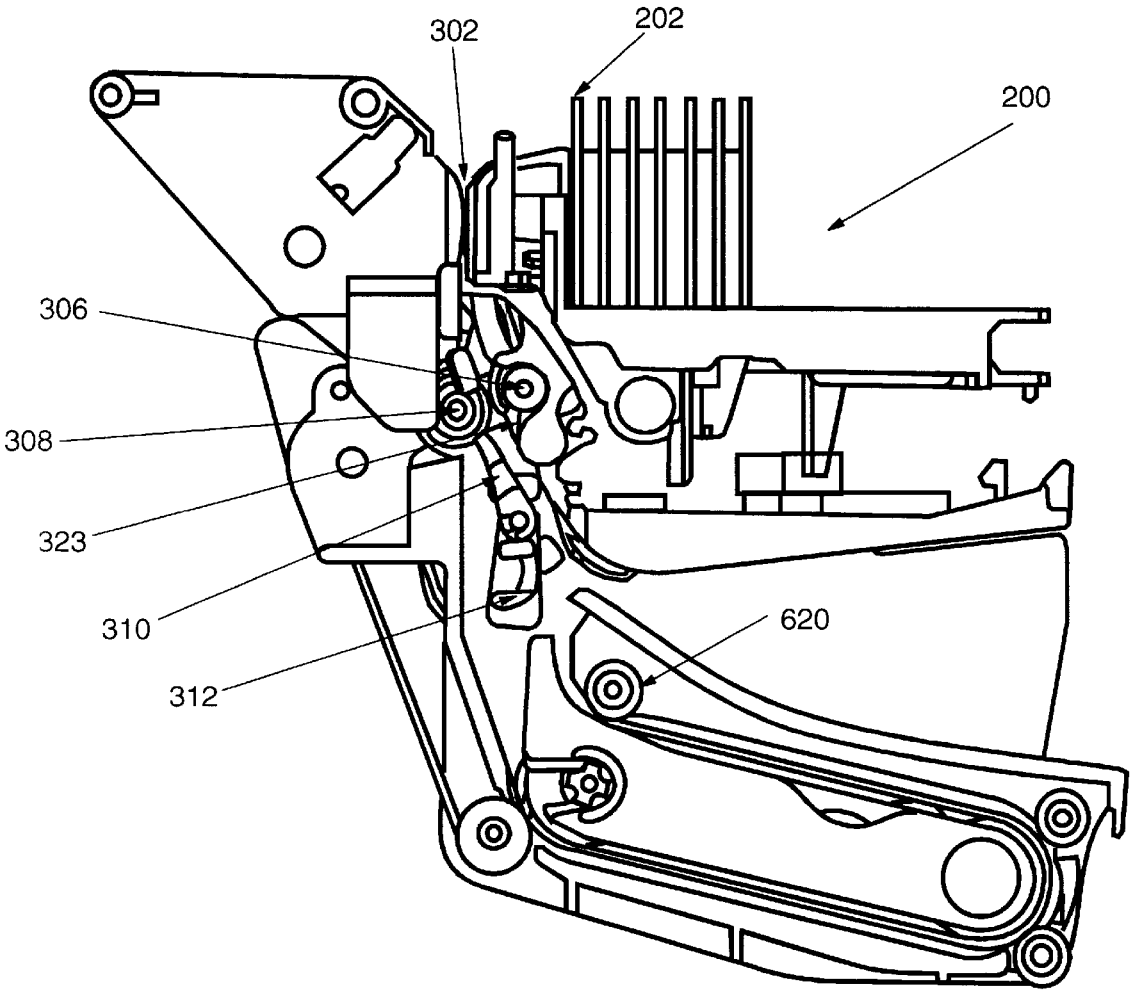
FIG. 7 illustrates the left side of the print head and check flipper subassembly of FIG. 2 in the flipping mode, with the upper gate moved towards its first position, and with the outer frame removed for clarity.

There is illustrated in FIG. 7, a view of print head and check flipper subassembly 200 as illustrated in FIG. 3. In FIG. 7, however, print head and check flipper subassembly 200 is shown with upper gate 310 moved toward its first position toward platen 210. As the check advances between the last idler 620, it is in a reversed, or "flipped" orientation such that the front face of the check, upon which the amount of purchase and the date will be printed is toward print head 202, and the lower edge of the check is closest to document entrance 302. As the lower edge of the check contacts upper gate 310, upper gate 310 moves in response toward its first position towards platen 210 to allow the check to pass. Lower gate 312 remains in the flipped position.

As the check is advanced past lower sensor 323, print head and check flipper subassembly 200 reverts to the normal print mode and front and rear feed rollers 306 and 308 close and begin to rotate in the reverse direction, pulling the check out of circular paper path 624. This advances the check past print head 202 where information such as the amount of the purchase, the date and the name of the selling establishment is printed in "landscape mode" along the width of the front face of the check. After printing is completed, front and rear feed rollers 306 and 308 advance the check out of document entrance 302, for retrieval by the cashier or operator. At the end of the process, a check is verified, endorsed and printed, ready to be presented to the customer for signing.

It should be understood that the process and mechanism described above would serve equally well for other documentation besides a check. Any document which would fit within the physical dimensions of the print head and check flipper subassembly 200 could be printed, whether such document is required to be printed on both sides, and whether such document contained MICR information. It shall also be understood that additional information could be printed on the face of a check or other document, such as a drivers license or phone number of the consumer, if such information is provided to the print head at the time of printing. Furthermore, it should be understood that print head and check flipper subassembly 200 could be modified to perform this flipping operation on larger and smaller documents.

Figure 8:
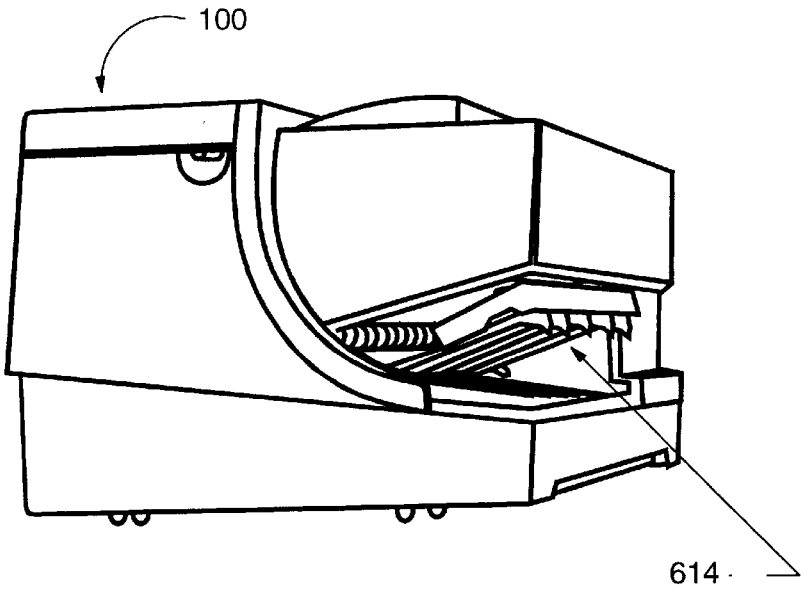
FIG. 8 illustrates a point of sale check printer having a print head and check flipper subassembly in accordance with the present invention, and shows the access door in an opened position.
Figure 9:
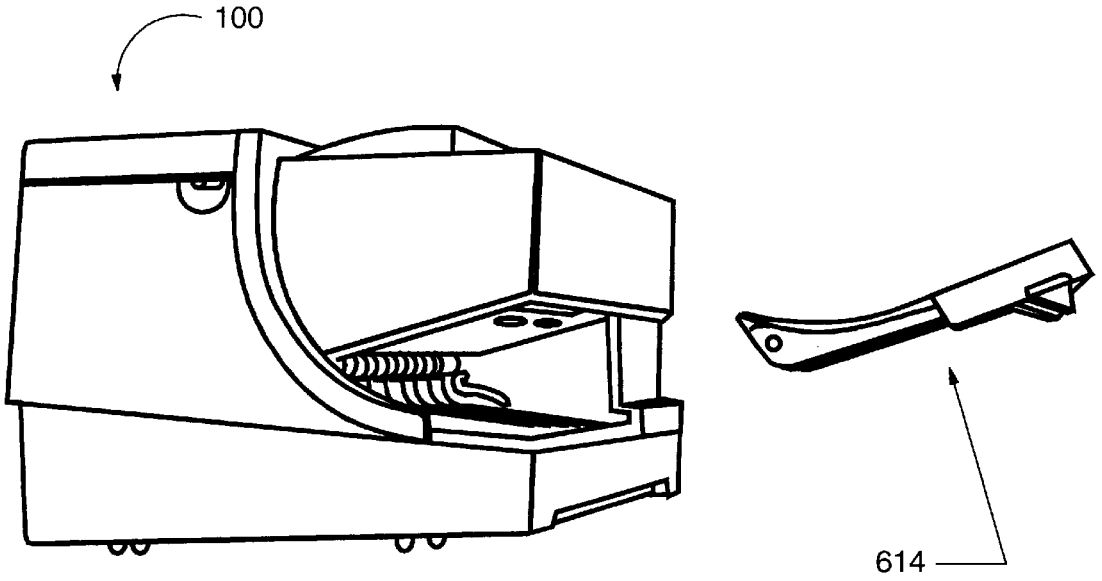
FIG. 9 illustrates the point of sale check printer of FIG. 9 with the access door removed.

Turning now to FIGS. 8 and 9, point of sale check printer 100 is used with a print head and check flipper subassembly (not shown). Point of sale check printer 100 has access door 614, which is lifted in FIG. 8 and is removed in FIG. 9.

Figure 10:
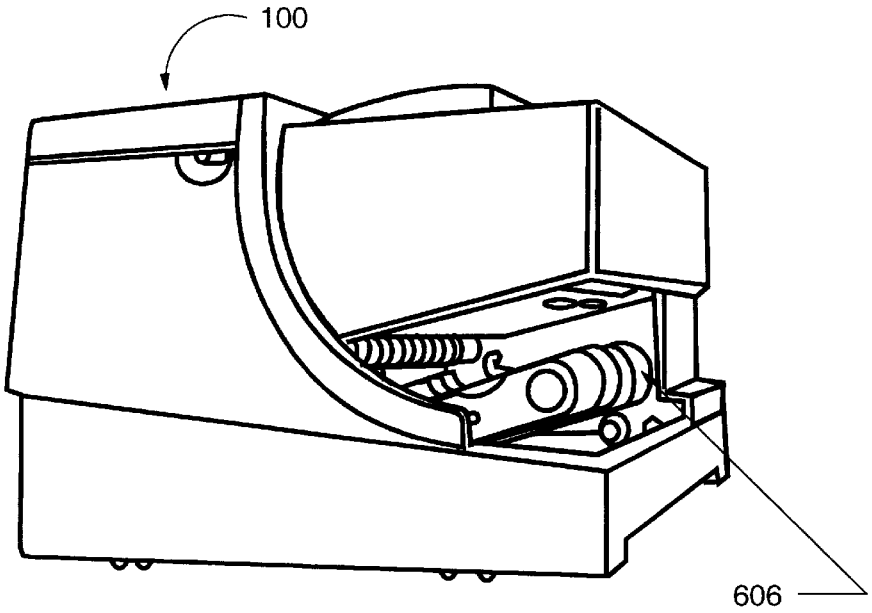
FIG. 10 illustrates the point of sale check printer of FIG. 9 with the flipper cartridge lifted.
Figure 11:
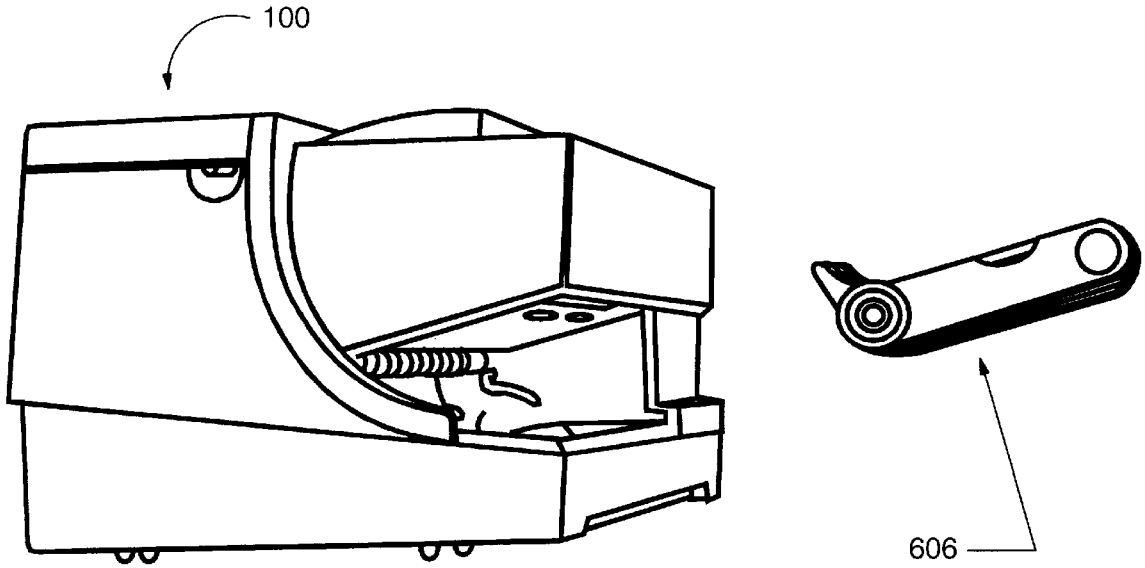
FIG. 11 illustrates the point of sale check printer of FIG. 9 with the flipper cartridge removed.

Turning now to FIGS. 10 and 11, point of sale check printer 100, used with print head and check flipper subassembly (not shown) is illustrated with flipper cartridge 606 lifted in FIG. 10 and removed in FIG. 11. Flipper cartridge 606 is removable to allow retrieval of a jammed or stuck check or other document in print head and check flipper subassembly, or to allow repair or replacement of flipper cartridge 606.

While preferred embodiments of the invention have been shown and described, it will be apparent to those skilled in the art that the conception and the specific embodiments disclosed may be readily utilized as a basis for modifying or designing other structures for carrying out the same purpose as the present invention. It should also be realized by those skilled in the art that such equivalent constructions do not depart from the spirit and scope of the invention as set forth in the appended claims.

What is claimed is:

1. An apparatus for printing information on first and second opposing faces of a document, comprising:

printer means for printing information on a selected one of said first and second opposing faces of said document disposed along a first path;

a first drive means for selectively bi-directionally transporting said document along said first path;

gating means for selectively routing said document from said first path to a circular path, said circular path and said gating means reversing orientation of said document upon reinsertion in said first path relative to said printer means; and a second drive means for transporting said document along said circular path, wherein:

said first drive means includes a freed roller gear;

said second drive means includes a driven gear;

and further comprising an idler gear driven by said feed roller gear, wherein said second drive means is driven by selectively engaging said idler gear with said driven gear.

2. The apparatus of claim 1, further comprising a lever having a first position and a second position, wherein said lever maintains said idler gear out of engagement with said driven gear in said first position, and allows said idler gear to engage said driven gear in said second position.

3. The apparatus of claim 2, wherein said printer means includes a printer head and a print head carrier, and wherein said lever is driven from said first position to said second position by said print head carrier.

4. The apparatus of claim 3, wherein said lever includes an angled surface and said print head carrier includes a post, and wherein said lever is driven from said first position to said second position by engagement of said post against said angled surface.

5. An apparatus for printing information on first said second opposing faces of a document, comprising:

printer means for printing information on a selected one of said first and second opposing faces of said document disposed along a first path;

a first drive means for selectively bi-directionally transporting said document along said first path; and gating means for selectively routing said document from said first path to a circular path, said circular path and said gating means reversing orientation of said document upon reinsertion in said first path relative to said printer means, wherein said gating means includes a first gate having a first position and a second position and a second gate having a first position and a second position, and wherein said document is directed along said first path when said first and second gates are in said first position, wherein said document is directed along said circular path when said first and second gates are in said second position, and wherein said document is directed from said circular path to said first path when said first gate is in said first position and said second gate is in said second position.

6. The apparatus of claim 1, wherein said driven gear of said second drive means includes a lateral extension for receiving a belt, wherein said second drive means further comprises a flipper drive wheel and a belt, said flipper drive wheel including a lateral extension for receiving a belt, said belt disposed around said lateral extension of said driven gear and said lateral extension of said flipper drive wheel.

7. The apparatus of claim 6, wherein said flipper drive wheel includes gear teeth.

8. A method of printing information on both faces of a document having two faces, comprising the steps of:

inserting a document into a point of sale check printer;

providing a signal that the document has been inserted;

rotating a feed mechanism in a forward direction;

advancing the document along a first path past a magnetic ink character reader;

providing a signal that the information written in magnetic ink on the document has been read;

rotating the feed mechanism in a reverse direction;

printing information with a print head on a first face of a document;

changing a position of a gate;

rotating the feed mechanism in a forward direction;

advancing the document into a second path;

advancing the second face of the document past the print head; and printing information on the second face of the document.

* * * * *